US007311527B1

(12) United States Patent
Hong et al.

(10) Patent No.: US 7,311,527 B1
(45) Date of Patent: Dec. 25, 2007

(54) CONNECTOR STRUCTURE

(75) Inventors: Siou-Yi Hong, Hukou Township, Hsinchu County (TW); Lun-Ting Liu, Hukou Township, Hsinchu County (TW)

(73) Assignee: Singatron Enterprise Co., Ltd., Hsinchu County (TW)

( * ) Notice: Subject to any disclaimer, the term of this patent is extended or adjusted under 35 U.S.C. 154(b) by 0 days.

(21) Appl. No.: 11/580,282

(22) Filed: Oct. 13, 2006

(51) Int. Cl.
*H01R 12/00* (2006.01)

(52) U.S. Cl. ..... 439/60

(58) Field of Classification Search ..... 439/60, 439/59, 95, 101, 108, 637, 638, 607
See application file for complete search history.

(56) References Cited

U.S. PATENT DOCUMENTS 3,587,029 A * 6/1971 Knowles ..... 439/607
5,882,223 A * 3/1999 Igarashi ..... 439/495
6,019,616 A * 2/2000 Yagi et al. ..... 439/108
6,056,600 A * 5/2000 Watanabe et al. ..... 439/607
7,165,994 B2 * 1/2007 Ferry et al. ..... 439/607

* cited by examiner

*Primary Examiner*—Phuong Dinh
(74) *Attorney, Agent, or Firm*—Troxell Law Office, PLLC

(57) ABSTRACT

A connector structure includes a connector structured from a cover casing, an insulating body, signal terminals and staggered terminals. The insulating body is disposed within the cover casing, and connecting portions and soldering portions extend from the cover casing. Moreover, a containing space is defined within the insulating body. Ribs having a guide positioning function are disposed within the containing space, and clasp grooves that fixedly hold staggered terminals, second passages and first passages having signal terminals penetrate therethrough are located within the insulating body. Each of the staggered terminals includes a pressure terminal and an earth terminal, which are in an up/down and right/left juxtaposed configuration. Electric conduction portions of the signal terminals enable electrical connection with a circuit board, thereby enabling the connector to achieve the objective of electrical conduction, and increase electrical conduction efficiency and reduce manufacturing cost.

4 Claims, 8 Drawing Sheets

CONNECTOR STRUCTURE

BACKGROUND OF THE INVENTION (a) Field of the Invention

The present invention relates to an improved connector structure, and more particularly to an improvement that has been made to terminals configured interior of a connector.

(b) Description of the Prior Art

Referring to FIG. 1, FIG. 2 and FIG. 3, which show a connector A of prior art comprising a cover casing A1, an insulating body A2, earth terminals A3 and signal terminals A4. The cover casing A1 and the insulating body A2 jointly form a pressure frame A5 that enables connecting to a pressure connector plug. Furthermore, the earth terminals A3 and the signal terminals A4 are disposed interior of the pressure frame A5. However, a complicated processing method is needed to fabricate installing the earth terminals A3 and the signal terminals A4, and time wasted in production results in wasted expenditure. Moreover, when connecting the pressure frame A5 to a pressure connector plug, the cover casing A1, which forms a side wall of the pressure frame A5, will arch outward, thereby resulting in being unable to produce the anticipated electric conducting function.

Hence, the inventor of the present invention proposes to resolve and surmount existent technical difficulties to eliminate the aforementioned shortcomings of prior art.

SUMMARY OF THE INVENTION

The art of the present invention provides an improved connector structure, and more particularly to an improvement that has been made to terminals configured interior of a connector, wherein a plurality of the terminals are disposed in an insulating body interior of a cover casing, and the terminals are staggered in an up/down and right/left juxtaposed configuration, thereby effectively increasing electric conduction efficiency.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
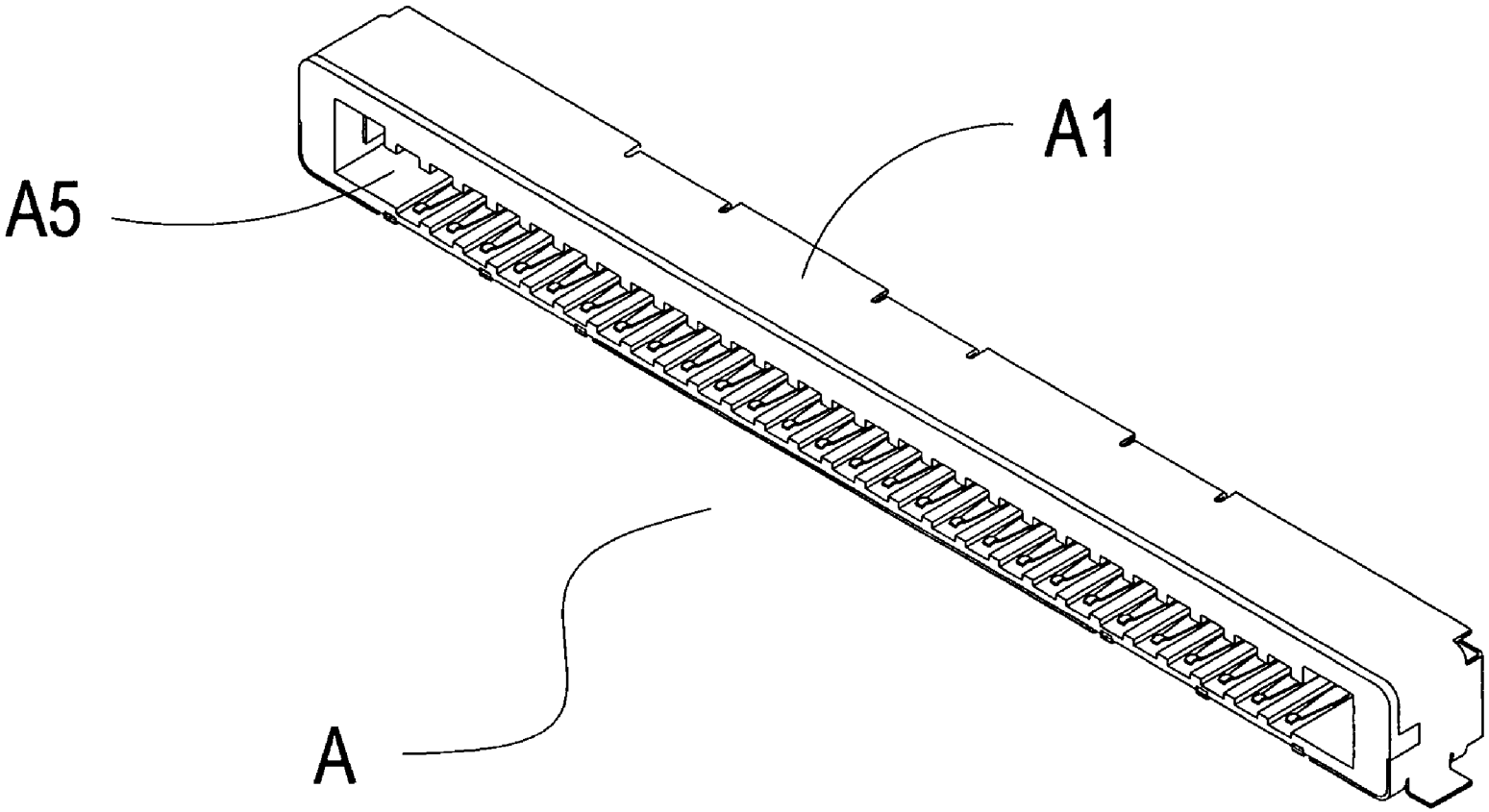
FIG.1 Prior Art
FIG. 1 shows an elevational view of prior art.
Figure 2:
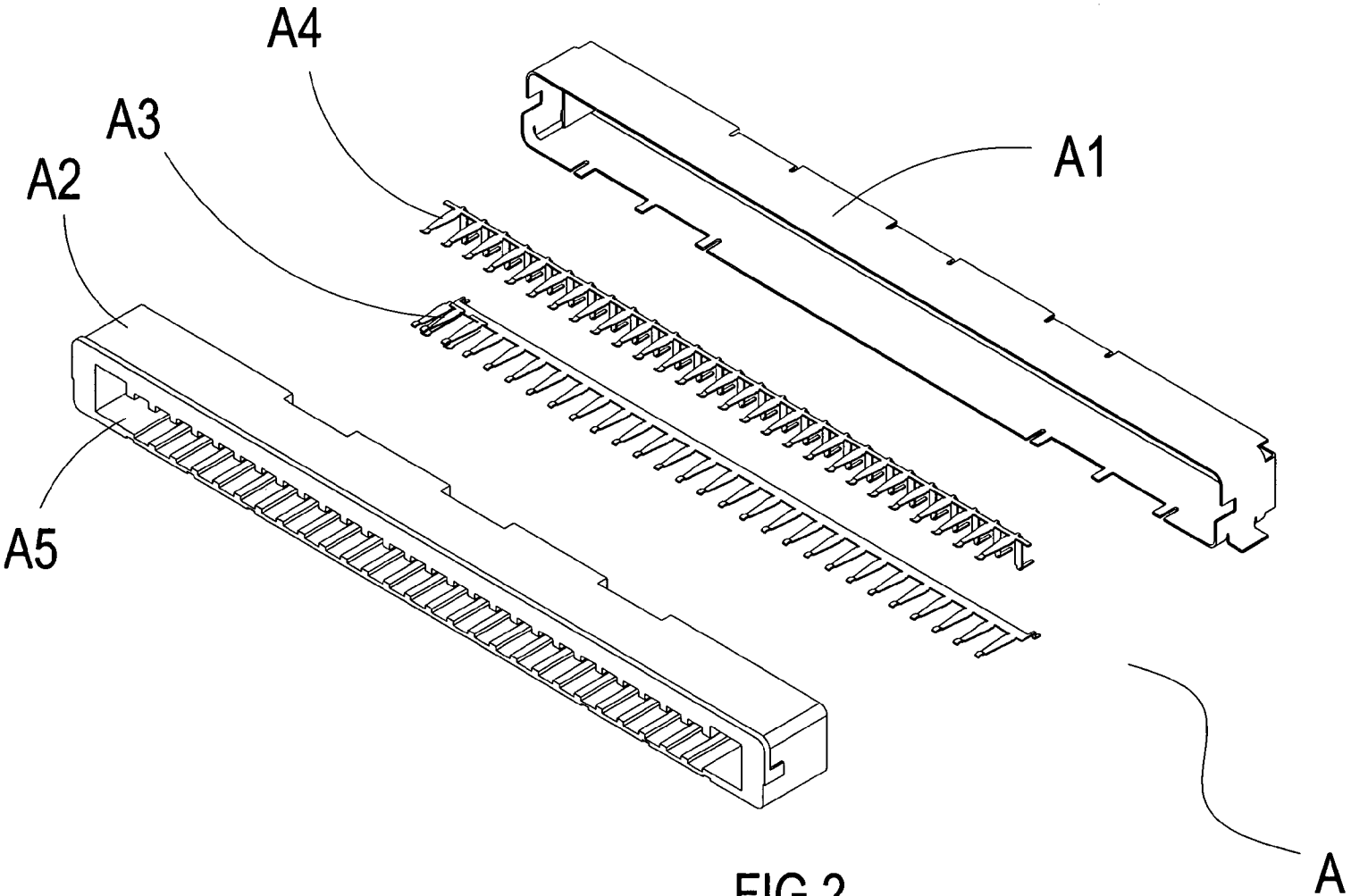
FIG.2 Prior Art
FIG. 2 shows an exploded elevational view of prior art.
Figure 3:
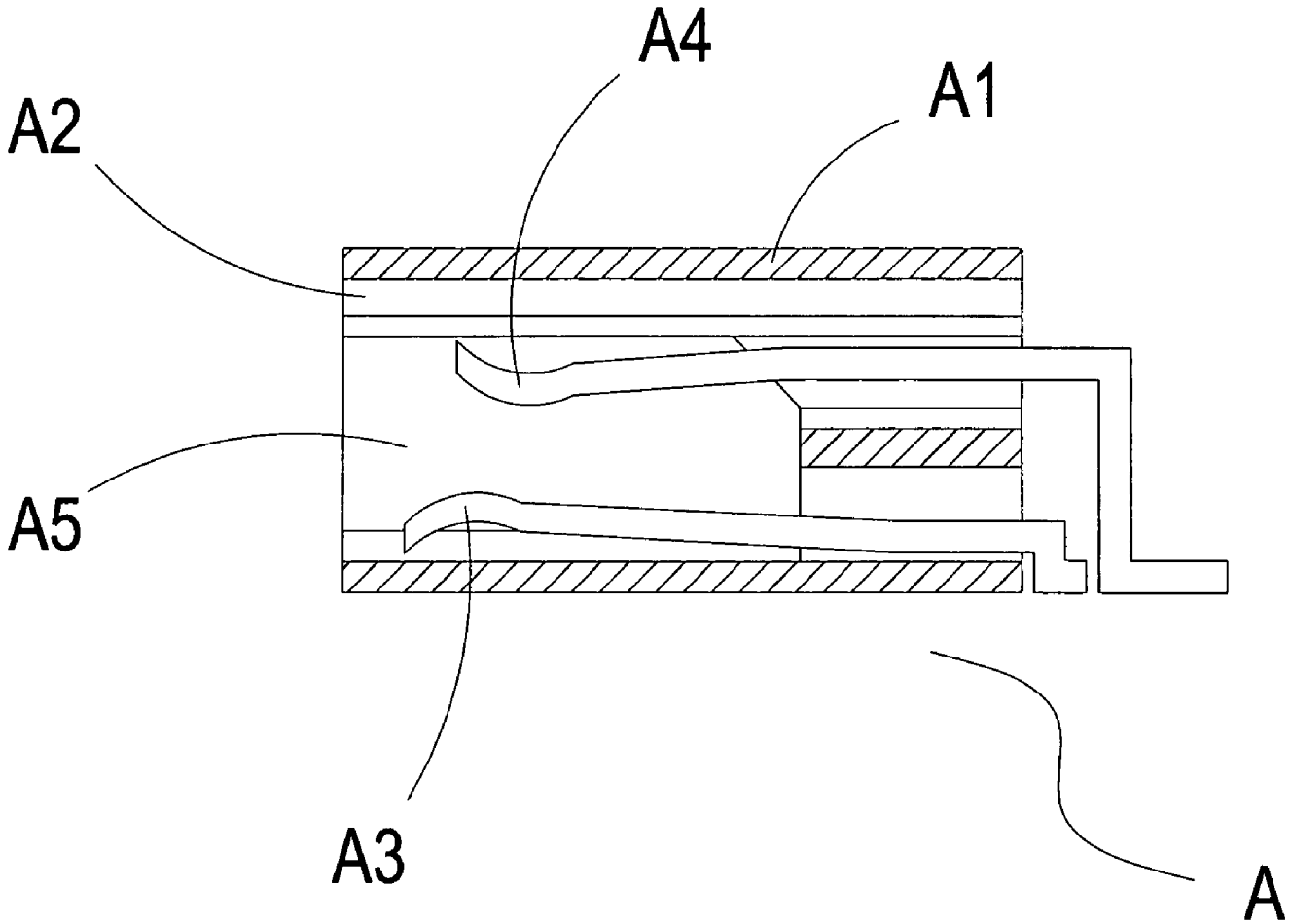
FIG.3 Prior Art
FIG. 3 shows a cross-sectional view of prior art.
Figure 4:
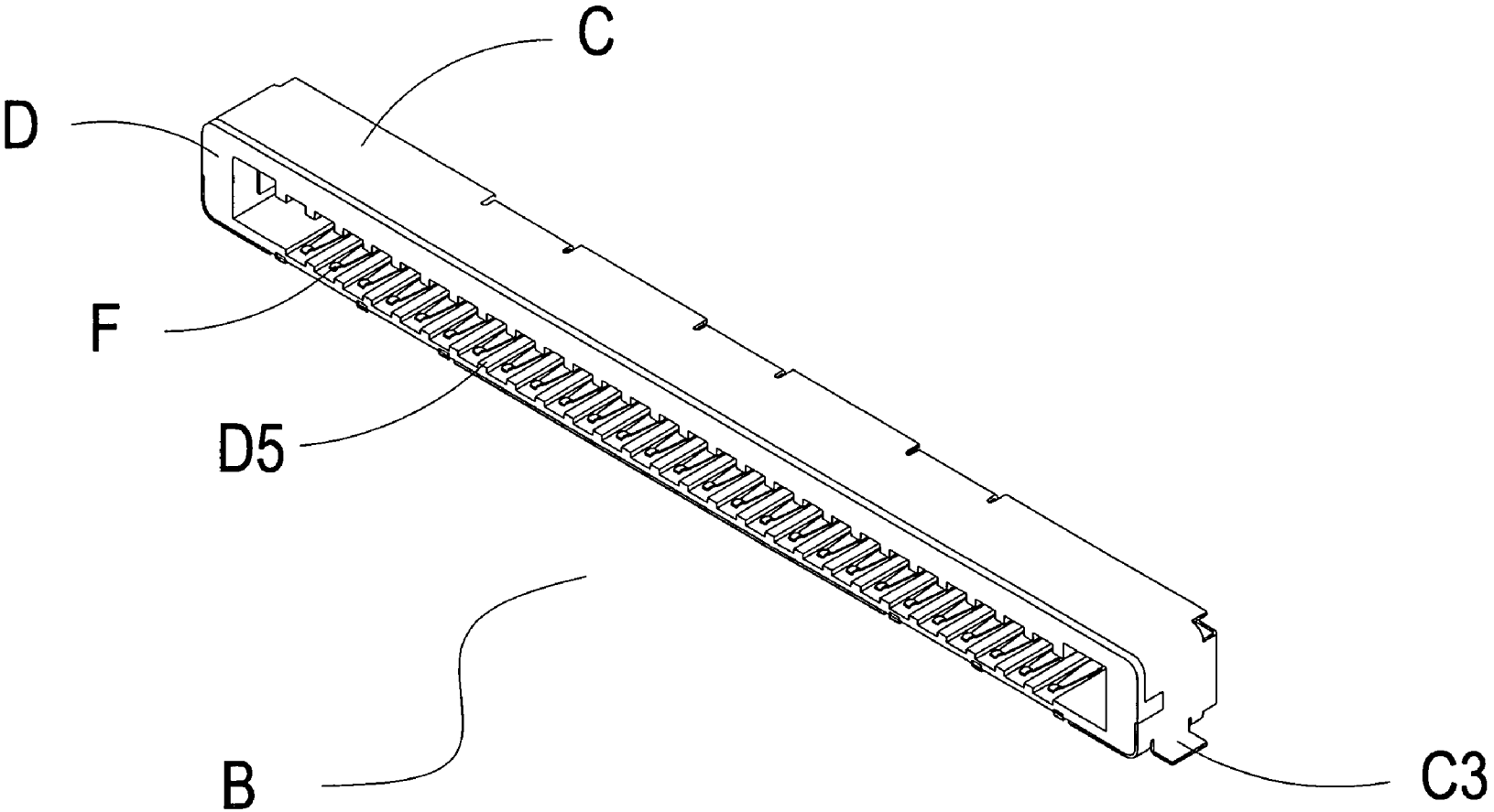
FIG. 4 shows an elevational view according to the present invention.
Figure 5:
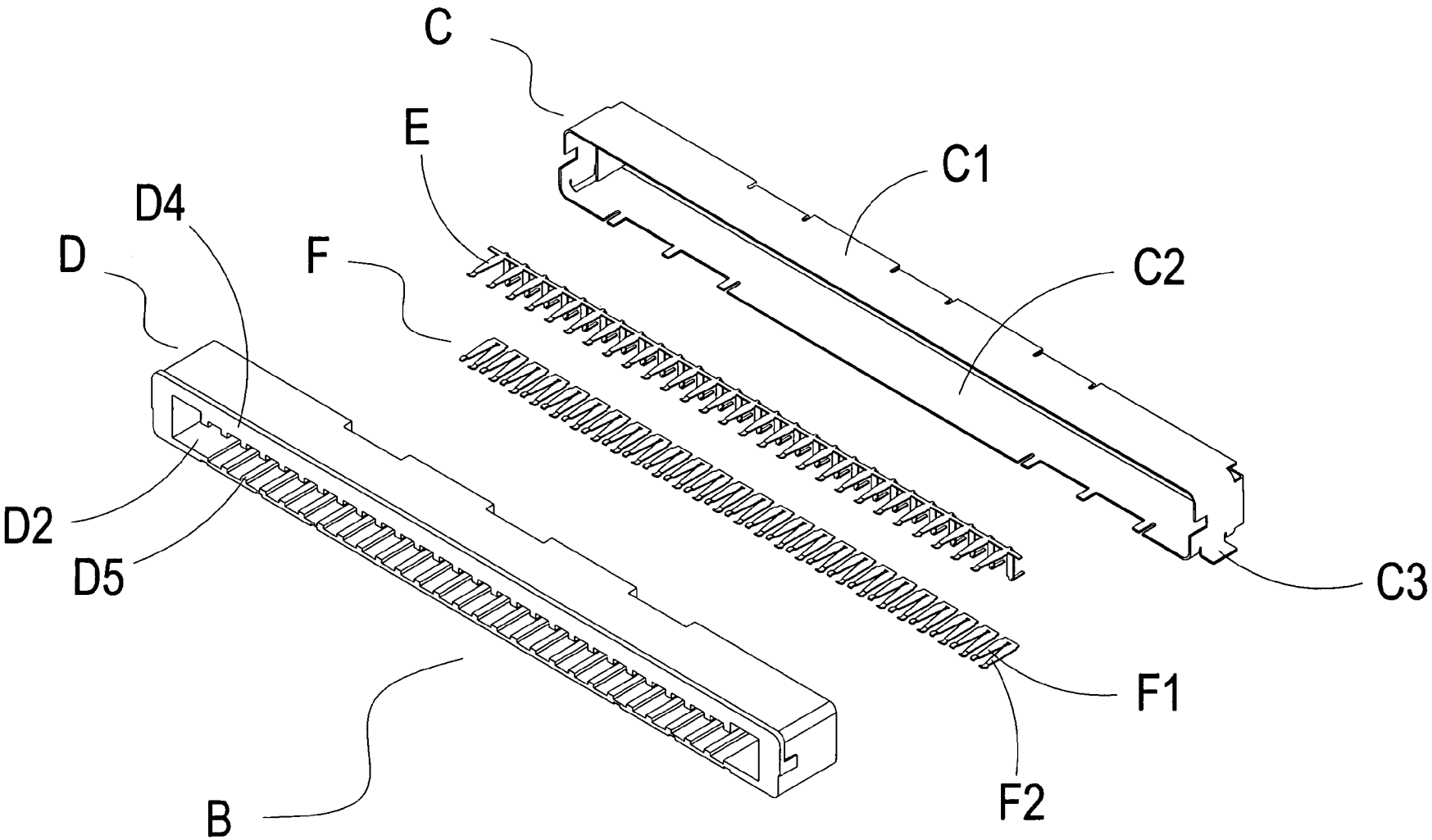
FIG. 5 shows an exploded elevational view according to the present invention.
Figure 6:
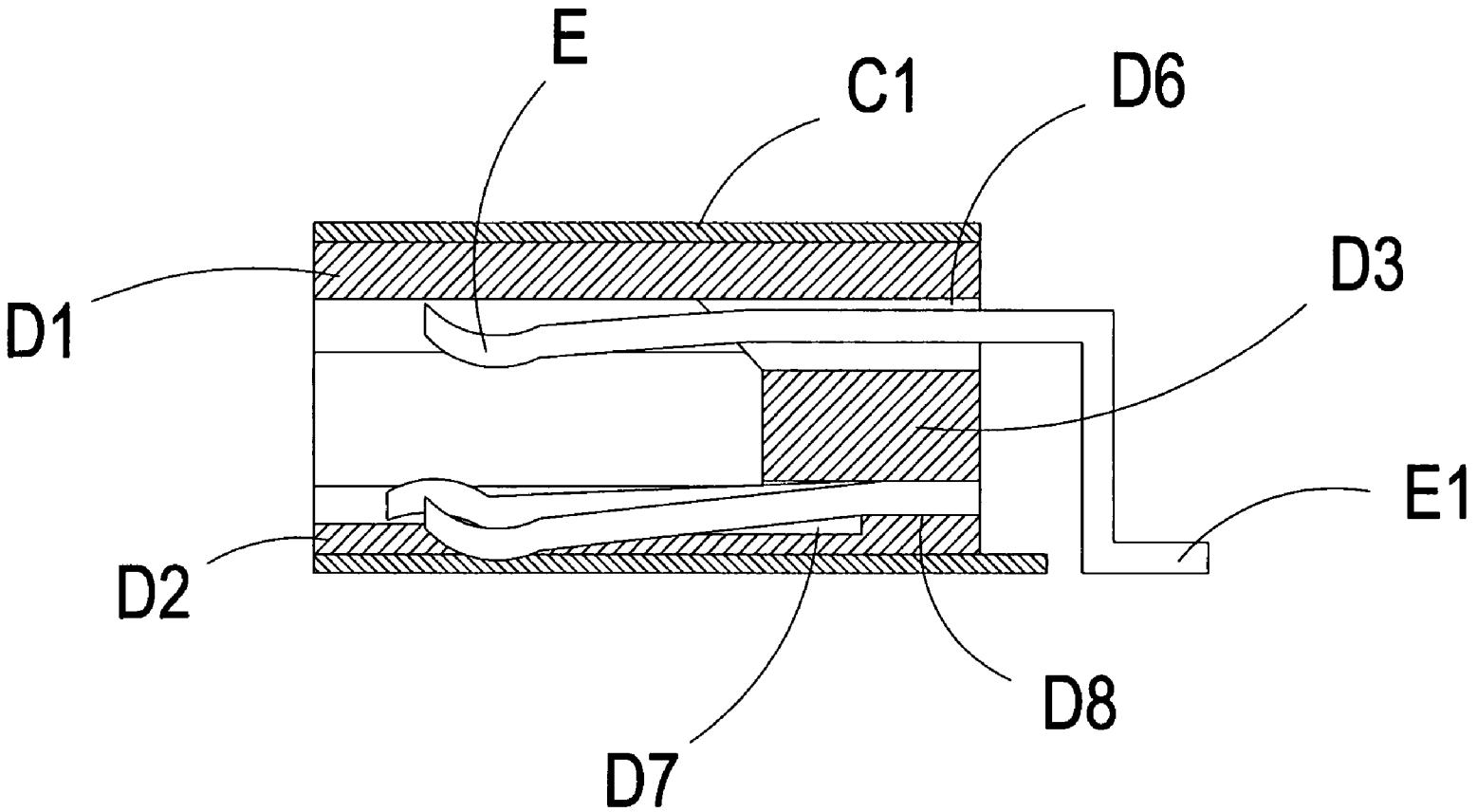
FIG. 6 shows a cross-sectional view according to the present invention.
Figure 7:
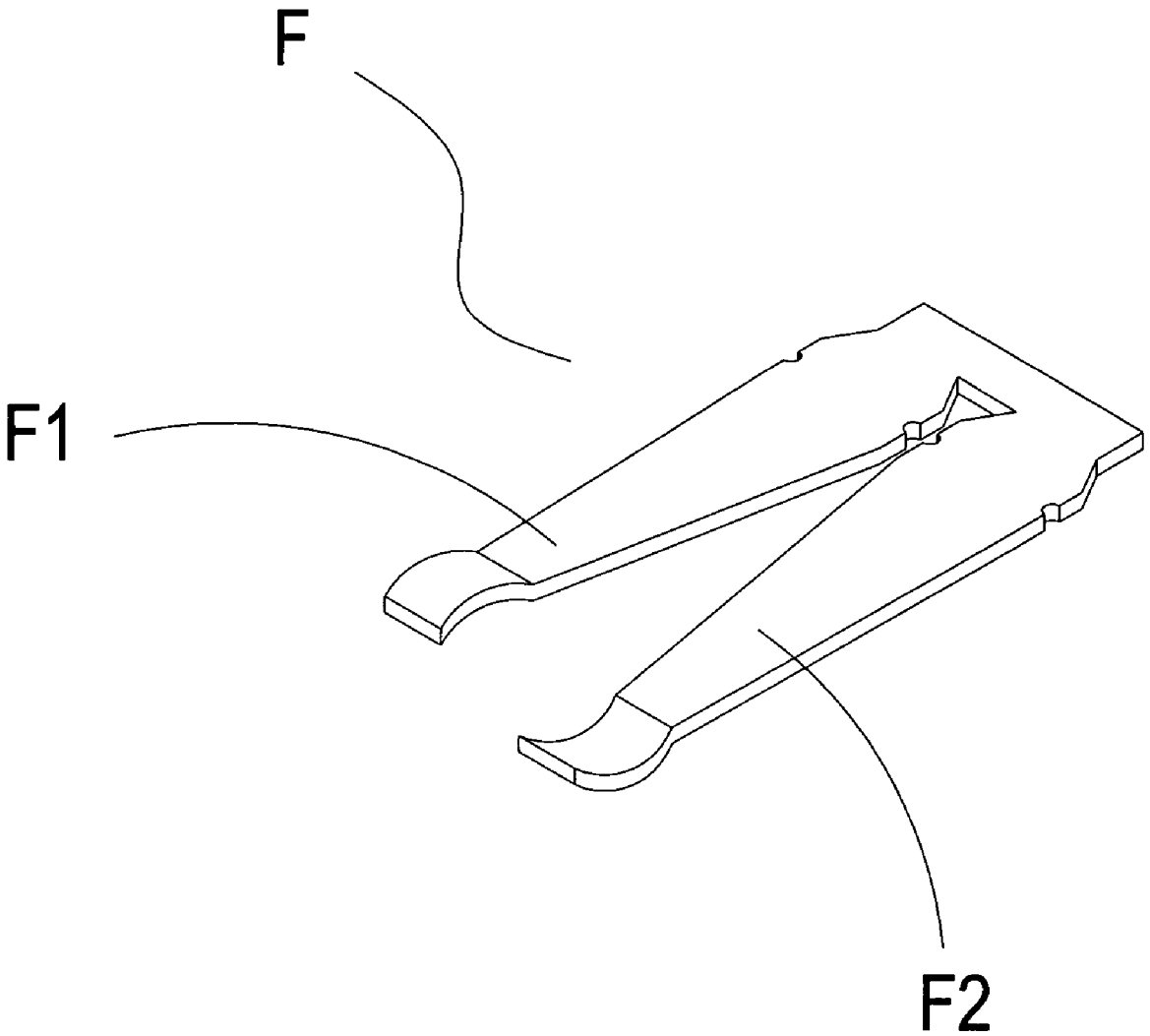
FIG. 7 shows a schematic view of a terminal according to the present invention.

Referring to FIG. 4, FIG. 5, FIG. 6 and FIG. 7, which show an improved connector structure of the present invention, wherein a connector B is structured to comprise a cover casing C, an insulating body D, signal terminals E and staggered terminals F, wherein the cover casing C comprises an upper casing C1 and a lower casing C2, and soldering portions C3 outwardly extend from two ends of the upper casing C1. Bases D3 extend between an upper insulating body D1 and a lower insulating body D2 of the insulating body D, thereby forming a containing space D4, and guiding ribs D5 are disposed on the upper insulating body D1 and the lower insulating body D2. First passages D6 penetrate between the upper insulating body D1 and the bases D3, and clasp grooves D7 are hollowed out of the lower insulating body D2.

The present invention is characterized in that the staggered terminals F are in an up/down and right/left juxtaposed configuration, wherein each of the staggered terminals F comprises a transmission signal pressure terminal F1. Moreover, the pressure terminals F1 penetrate between the bases D3 and second passages D8 of the lower insulating body D2, and the second passages D8 tightly hold the pressure terminals F1. Each of the staggered terminals F further comprises an earth terminal F2 providing an earthing function, and the clasp grooves D7 correspond to the earth terminals F2, thereby enabling the clasp grooves D7 to firmly hold the earth terminals F2 and embed into the lower insulating body D2, and thus enabling the earth terminals F2 to be biased against the cover casing C to achieve earthing effectiveness. Furthermore, the signal terminals E have electric conducting portions E1 that electrically connect to a circuit board, thereby achieving the objective of electrically connecting the connector B.

Figure 8:
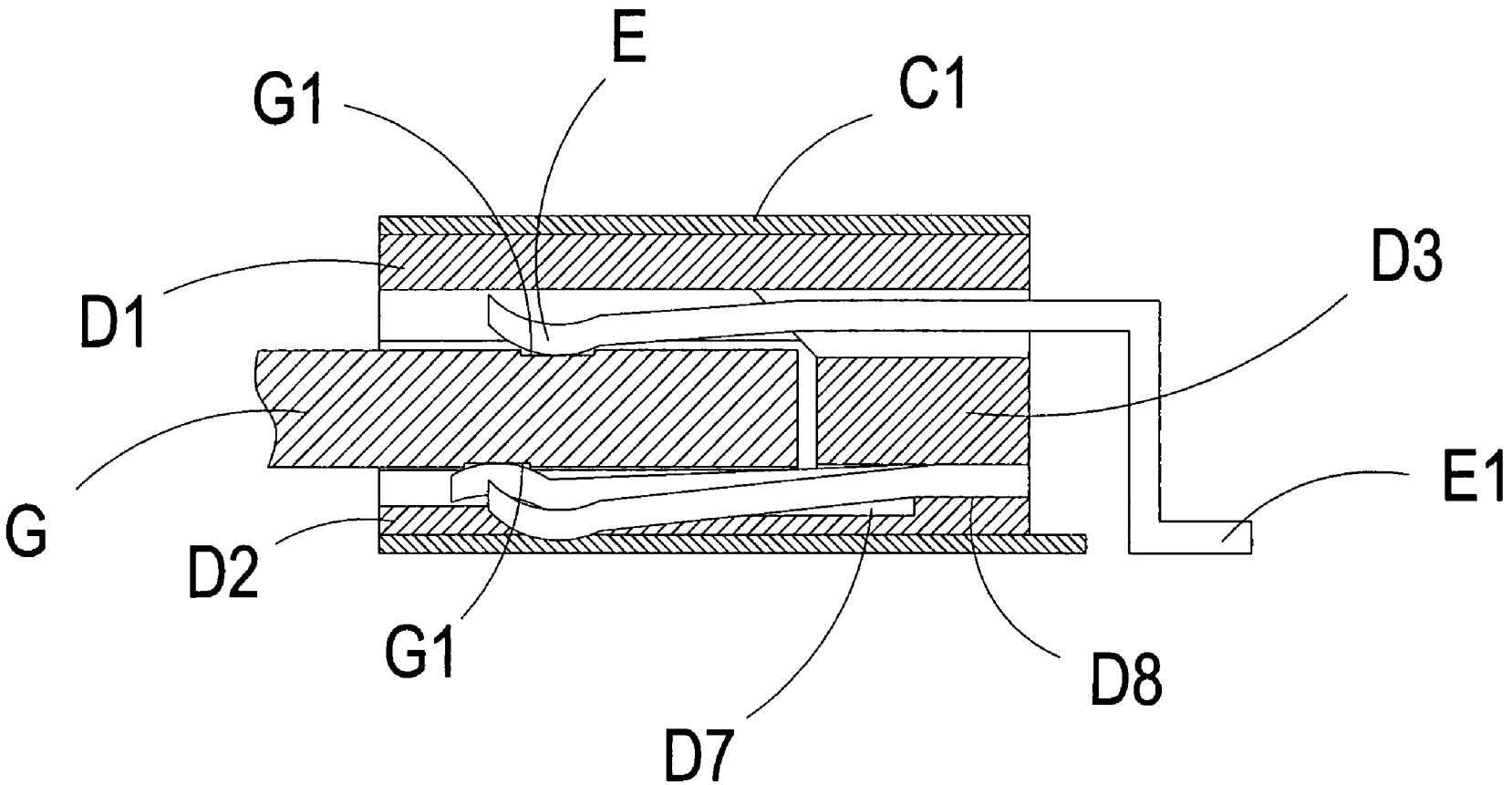
FIG. 8 shows a cross-sectional view of an embodiment according to the present invention.

Referring to FIG. 5, FIG. 6, FIG. 7 and FIG. 8, which show an embodiment of the improved connector structure of the present invention, wherein the insulating body D is contained within the cover casing C of the connector B, and the cover casing C comprises the upper casing C1 and the lower casing C2. Moreover, the soldering portions C3, which enable fixedly soldering the connector B to a circuit board, outwardly extend from the two sides of the upper casing C1. Furthermore, the containing space D4 is provided within the insulating body D located between the upper casing C1 and the lower casing C2. The containing space D4 of the insulating body D is formed by the upper insulating body D1 and the lower insulating body D2, and the ribs D5 having a guide positioning function are correspondingly located on the upper insulating body D1 and the lower insulating body D2 within the containing space D4. Moreover, the bases D3 extend between the upper insulating body D1 and the lower insulating body D2, and the first passages D6 penetrate between the bases D3 and the upper insulating body D1. The first passages D6 enable the signal terminals E to penetrate into the containing space D4 to enable electrical connecting thereto, and the first passages D6 are further used to firmly hold the signal terminals E. Furthermore, the second passages D8 penetrate between the bases D3 and the lower insulating body D2, and the clasp grooves D7 are hollowed out of the lower insulating body D2. The second passages D8 and the clasp groves D7 enable the pressure terminals F1 and the earth terminals F2 of the staggered terminals F to be firmly disposed within the insulating body D.

Each of the staggered terminals F comprises the pressure terminal F1 and the earth terminal F2, and the pressure terminal F1 and the earth terminal F2 of the staggered terminals F are in an up/down and right/left juxtaposed configuration. Moreover, the pressure terminals F1 penetrate the second passages D8 into the containing space D4 for use to enable electrical connecting signals thereto, and the earth terminals F2 are disposed in the lower insulating body D2, thereby enabling the clasp grooves D7 of the lower insulating body D2 to fix the earth terminals F2 within the containing space D4, and thus enabling the earth terminals F2 to be biased against the cover casing C and provide an earthing function. Furthermore, the electric conducting portions E1 correspondingly extend from the signal terminals E to enable electrical connection to a circuit board, and the first passages D6 between the bases D3 and the upper insulating body D1 enable the signal terminals E to pass therethrough and be firmly fixed therein.

The connector B comprises one or more than one of the signal terminals E and the pressure terminals F. and the connector B comprises one or more than one of the ribs D5. Moreover, a pressure connector plug G comprises one or more than one exposed contact G1. When the pressure connector plug G is plugged into the containing space D4 to effect an electrical connection therewith, the signal terminals E and the earth terminals F1 are compressed, and electrical connection of the signal terminals E, the pressure terminals F1 and the electric conducting portions E3, in conjunction with the earthing function of the earth terminals F2, enables the pressure connector plug G and the connector B to achieve an optimum electric conducting function.

In order to better explicitly disclose advancement and practicability of the present invention, a comparison with prior art is described hereinafter:

SHORTCOMINGS OF PRIOR ART

1. When a pressure connector plug is plugged into a pressure frame of prior art, a side wall cover casing arches outwards.
2. Shortcoming 1 results in being unable to produce the anticipated electric conducting function.
3. A complicated processing method is needed to fabricate assembly,

ADVANTAGES OF THE PRESENT INVENTION

1. The pressure terminals F1 and pressure portions of the staggered terminals F prevent the occurrence of bulging in the cover casing C.
2. Advantage 1 results in substantially improving electric conduction efficiency.
3. The staggered terminals F can be easily inserted within the cover casing C and the insulating body D, thereby reducing manufacturing cost.
4. Provided with advancement and practicability.
5. Enhances industrial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A connector structure comprising a cover casing, an insulating body, signal terminals and staggered terminals, wherein a space is defined within the cover casing of a connector, and the insulating body is disposed within the space; a containing space is defined within the insulating body, and a plurality of arranged ribs extend within the containing space; signal terminals and staggered terminals extend into and are arranged between the ribs; the connector structure is characterized in that pressure terminals and earth terminals of the staggered terminals assume an up/down and right/left juxtaposed configuration, the pressure terminals penetrate between passages of the insulating body and enable electrical connection in the containing space, and the earth terminals are biased against the cover casing; thus, when the connector is electrically connected to a pressure connector plug, electrical conduction efficiency between the connector and the pressure connector plug is increased and manufacturing cost reduced.

2. The connector structure according to claim 1, wherein the ribs provide a position fixing function when the terminals are inserted into the cover casing and the insulating body, thereby maintaining an appropriate distance between the terminals, and facilitating inserting the terminals into the cover casing and the insulating body.

3. The connector structure according to claim 1, wherein an end of each of the terminals is an electric conducting portion, and the extended electric conducting portions are soldered to a circuit board to form an electrical connection with the circuit board, thereby forming an electrical connection between the connector and the circuit board, and achieving functionality to connect and effect electric conduction with a circuit board.

4. The connector structure according to claim 1, wherein the cover casing comprises bilateral soldering portions, and the soldering portions function to enable fixedly soldering the connector to a circuit board, and are further provided with earthing effectiveness.

* * * * *